US007395830B2

(12) United States Patent
Seo

(10) Patent No.: US 7,395,830 B2
(45) Date of Patent: Jul. 8, 2008

(54) COLLAPSIBLE CANOPY FRAME AND LOCKING PIN ASSEMBLY FOR THE SAME

(75) Inventor: Dong Woog Seo, Taegu (KR)

(73) Assignee: Caravan Canopy International Inc., La Mirada, CA (US)

( * ) Notice: Subject to any disclaimer, the term of this patent is extended or adjusted under 35 U.S.C. 154(b) by 776 days.

(21) Appl. No.: 10/728,154

(22) Filed: Dec. 4, 2003

(65) Prior Publication Data

US 2004/0141803 A1 Jul. 22, 2004

(30) Foreign Application Priority Data

Jan. 17, 2003 (KR) ..... 20-2003-0001543

(51) Int. Cl.

| | |
|---|---|
| ***E04H 15/46*** | (2006.01) |
| ***E04H 15/32*** | (2006.01) |
| ***E04H 15/38*** | (2006.01) |
| ***F16B 7/10*** | (2006.01) |
| ***F16B 21/00*** | (2006.01) |

(52) U.S. Cl. ..... 135/140; 135/120.3; 135/131; 403/109.3; 403/324; 403/109.7

(58) Field of Classification Search ..... 135/75, 135/120.3, 24, 40, 131, 140, 141, 145, 146; 248/407, 408, 188.5; 182/204; 16/113.1; 403/109.1, 109.2, 109.3, 109.6, 109.8, 324, 403/325, 378; 292/170, 182, 187

See application file for complete search history.

(56) References Cited

U.S. PATENT DOCUMENTS 1,257,998 A * 3/1918 Gruber ..... 292/170
1,571,453 A * 2/1926 Maxon ..... 292/170
1,592,356 A 7/1926 Goldberg et al.
1,845,143 A 2/1932 Friesner (Continued)

FOREIGN PATENT DOCUMENTS

GB 742903 1/1956

(Continued)

*Primary Examiner*—Robert Canfield
*Assistant Examiner*—Brent W Herring
(74) *Attorney, Agent, or Firm*—Christie, Parker & Hale, LLP.

(57) ABSTRACT

A locking pin assembly includes a button that can be moved in a first direction from a first position to a second position, and a first biasing member for biasing the button to be normally in the first position. The locking pin assembly also includes a locking pin member that engages the button and is movable in a second direction, which is substantially perpendicular to the first direction, from a third position to a fourth position when the button is moved from the first position to the second position. The locking pin assembly also includes a second biasing member for biasing the locking pin member to be normally in the third position. The locking pin assembly can be used in a collapsible canopy frame to adjust the height of a telescoping side pole by fixing upper and lower sections to each other and/or to fix the edge scissor assemblies and the side poles in an opened position. When used in a collapsible canopy, the locking pin assembly releases the side pole (or a section thereof) when the button is pressed to disengage the locking pin member from a hole formed on the side pole.

23 Claims, 7 Drawing Sheets

U.S. PATENT DOCUMENTS

| | | | | | |
|---|---|---|---|---|---|
| 2,130,919 | A | | 9/1938 | Erickson et al. | |
| 3,737,184 | A | * | 6/1973 | Swartz | 292/170 |
| 3,890,814 | A | * | 6/1975 | Fantoni | 70/106 |
| 4,641,676 | A | | 2/1987 | Lynch | |
| 4,947,884 | A | | 8/1990 | Lynch | |
| 5,421,356 | A | * | 6/1995 | Lynch | 135/145 |
| 5,567,080 | A | | 10/1996 | Sterlacci | |
| 5,632,292 | A | | 5/1997 | Carter | |
| 5,702,198 | A | | 12/1997 | Kuo | |
| 5,845,664 | A | * | 12/1998 | Ryder et al. | 135/65 |
| 5,862,572 | A | | 1/1999 | Lin et al. | |
| 6,070,604 | A | | 6/2000 | Carter | |
| 6,089,247 | A | | 7/2000 | Price | |
| 6,141,828 | A | | 11/2000 | Kuo | |
| 6,152,157 | A | | 11/2000 | Jang | |
| 6,199,572 | B1 | | 3/2001 | Rousselle et al. | |
| 6,240,940 | B1 | | 6/2001 | Carter | |
| 6,508,262 | B1 | | 1/2003 | Takayama | |
| 6,575,656 | B2 | | 6/2003 | Suh | |
| 6,672,183 | B2 | * | 1/2004 | Johnson | 81/466 |
| 6,889,582 | B2 | * | 5/2005 | Wilhelm | 81/177.85 |
| 6,951,327 | B1 | * | 10/2005 | Seo | 248/188 |
| 7,299,813 | B2 | * | 11/2007 | Ochi | 135/145 |
| 7,311,113 | B2 | * | 12/2007 | Suh | 135/145 |
| 7,328,715 | B2 | * | 2/2008 | Neubardt | 135/40 |
| 2002/0074032 | A1 | | 6/2002 | Park et al. | |
| 2003/0029490 | A1 | | 2/2003 | Price et al. | |
| 2003/0131877 | A1 | | 7/2003 | Carter | |
| 2004/0182430 | A1 | * | 9/2004 | Seo | 135/131 |
| 2006/0062632 | A1 | * | 3/2006 | Jang | 403/109.6 |
| 2006/0096631 | A1 | * | 5/2006 | Mallookis et al. | 135/131 |
| 2007/0240748 | A1 | * | 10/2007 | Bae | 135/145 |
| 2008/0017232 | A1 | * | 1/2008 | Zeigler | 135/131 |
| 2008/0017234 | A1 | * | 1/2008 | Zeigler | 135/151 |

FOREIGN PATENT DOCUMENTS

| | | | |
|---|---|---|---|
| GB | 2 327 456 | A | 1/1999 |
| WO | WO 02/095165 | A3 | 11/2002 |

* cited by examiner

COLLAPSIBLE CANOPY FRAME AND LOCKING PIN ASSEMBLY FOR THE SAME

CROSS-REFERENCE TO RELATED APPLICATION(S)

This application claims priority to and the benefit of Korean Utility Model Application No. 2003-0001543 filed on Jan. 17, 2003 in the Korean Intellectual Property Office, now registered as Utility Model Registration No. 0312122 on Apr. 21, 2003, the entire contents of which are incorporated herein by reference.

FIELD OF THE INVENTION

The present invention relates to collapsible canopies, and more particularly to collapsible canopies having X-shaped scissor assemblies and side poles whose height can be adjusted.

BACKGROUND

In collapsible canopy frames having side poles and edge scissor assemblies that interconnect the side poles, side poles are often telescopically extendable. For example, each telescoping side pole has an upper section and a lower section that are slidably coupled to one another. This way, the size of the canopy frame in the collapsed state can be reduced. To maintain the side pole in an extended position, a locking mechanism is typically used. Locking mechanisms are also used to lock sliding mounting brackets pivotably coupled to lower outer ends of the edge scissor assemblies to the side pole such that the edge scissor assemblies can be fixed in an extended position when the canopy frame has been opened.

Pull pin assemblies are typically used as the locking mechanism in the collapsible canopies. Such pull pin assemblies have a pulling member such as a ring attached to the head of the pin. The locking mechanism is disengaged by pulling such pulling member. However, such pulling mechanism is often cumbersome to use in that the user holds the side pole with one hand while pulling the pulling member with the other. Therefore, there is a need for a locking mechanism for height adjustment as well as for fixing the sliding mounting bracket to the side pole that can be operate using one hand.

SUMMARY

In an exemplary embodiment according to the present invention, a locking pin assembly is provided. The locking pin assembly includes a button that is movable in a first direction from a first position to a second position. The locking pin also includes a first biasing member for biasing the button to be normally in the first position. In addition, the locking pin assembly includes a locking pin member engaging the button and movable in a second direction, which is substantially perpendicular to the first direction, from a third position to a fourth position when the button is moved from the first position to the second position. The locking pin assembly also includes a second biasing member for biasing the locking pin member to be normally in the third position.

In another exemplary embodiment of the present application, a collapsible canopy frame is provided. The collapsible canopy frame includes a plurality of telescoping side poles. Each telescoping side pole has an upper section and a lower section. A height adjustment bracket is mounted on each telescoping side pole. The height adjustment bracket includes a fixing section for engaging the upper section, and a first locking pin assembly connected to the fixing section.

The first locking pin assembly includes a first button that is movable in a first direction from a first position to a second position, and a first biasing member for biasing the button to be normally in the first position. The first locking pin member engaging the first button is movable in a second direction, which is substantially perpendicular to the first direction, from a third position for fixing the upper and lower telescoping sections together to a fourth position for disengaging the lower telescoping section from the upper telescoping section when the first button is moved from the first position to the second position. A second biasing member is used to bias the first locking pin member to be normally in the third position.

A set of edge scissor assemblies that are pivotably coupled between each of pairs of the side poles. Each of said edge scissor assemblies has relatively rotatable ribs. A stationary mounting bracket is fixedly mounted at top of each telescoping side pole. The stationary mounting bracket is pivotably coupled with upper outer ends of two respective edge scissor assemblies. A sliding mounting bracket is slidably mounted between the stationary mounting bracket and the height adjustment bracket on each telescoping side pole. The sliding mounting bracket is pivotably coupled with lower outer ends of two respective edge scissor assemblies.

In yet another exemplary embodiment of the present invention, the sliding mounting bracket includes a sliding section for slidably engaging the upper section of the telescoping side pole, and a second locking pin assembly connected to the sliding section. The sliding mounting bracket also includes a second button movable in a third direction from a fifth position to a sixth position, and a third biasing member for biasing the second button to be normally in the fifth position.

A second locking pin member engages the second button and is movable in a fourth direction, which is substantially perpendicular to the third direction, from a seventh position for fixing the sliding mounting bracket to the upper section of the side pole to an eighth position for disengaging the sliding mounting bracket from the upper section of the side pole when the second button is moved from the fifth position to the sixth position. A fourth biasing member is used to bias the second locking pin member to be normally in the seventh position.

These and other aspects of the invention will be more readily comprehended in view of the discussion herein and accompanying drawings, in which like reference numerals designate like elements.

DETAILED DESCRIPTION

Figure 1:
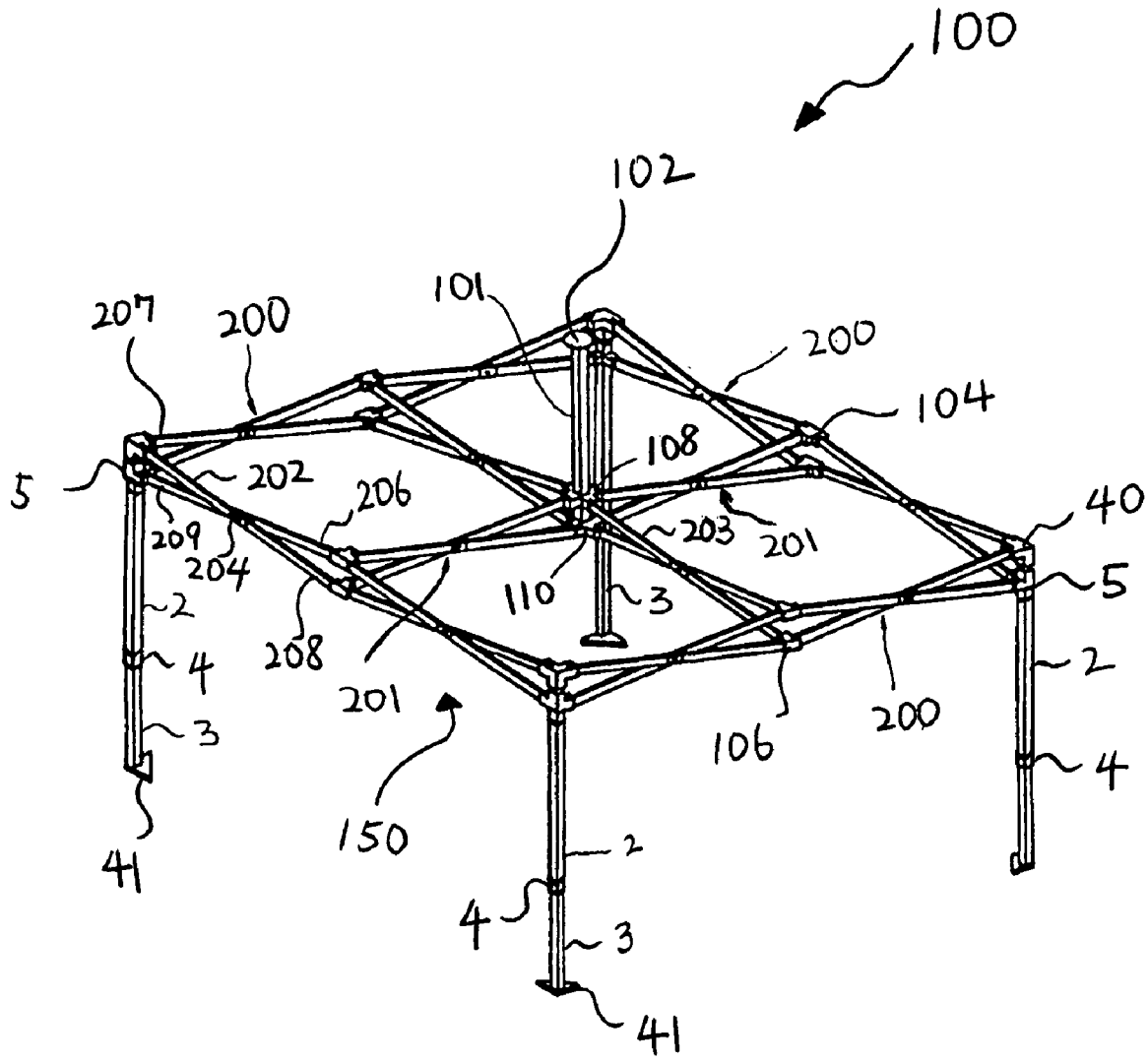
FIG. 1 is a perspective view of a canopy frame in an exemplary embodiment of the present invention

FIG. 1 illustrates a canopy frame 100 in an exemplary embodiment according to the present invention. The canopy frame 100 includes a center support pole 101, four telescoping side poles 1 and edge scissor assemblies 200 that interconnect each pair of adjacent side poles 1. Each of the edge scissor assemblies 200 are formed of a pair of ribs 202 connected together and rotatable about a pivot 204.

Each telescoping side pole 1 has a substantially square cross-section, and has attached at the bottom a triangular support plate 41. Canopy frames in other embodiments may include more than four side poles. Each pair of adjacent side poles 1 are interconnected to each other through a set 150 of two edge scissor assemblies 200. The set 150 of edge scissor assemblies 200 are pivotably coupled to the respective side poles 1 and to each other. Upper and lower inner ends 206, 208 of each edge scissor assembly 200 is pivotably coupled to the upper and lower inner ends of the other edge scissor assembly 200 of the same set 150 via upper and lower connecting brackets 104 and 106, respectively.

At the top of the center support pole 101 is a convex shaped head member 102, which can support a canopy cover at the center of the canopy frame. Also, the center support pole 101 has mounted thereon an upper central hub 108 and a lower central hub 110. The upper central hub 108 is slidable with respect to the center support pole 101 while the lower central hub 110 is substantially stationary with respect to the center support pole 101.

Each telescoping side pole includes two telescoping sections 2 and 3, which correspond to upper and lower sections, respectively. The upper and lower sections 2 and 3 are fixed to each other with a height adjustment bracket 4. Each telescoping side pole 1 has a stationary bracket 40 and a sliding bracket 5 mounted thereon. At each corner of the canopy frame 100, outer upper ends 207 of the edge scissor assemblies 200 are pivotably coupled to the corresponding stationary bracket 40. In addition, lower outer ends 209 of the edge scissor assemblies 200 are pivotably coupled to the sliding bracket 5.

Each of center scissor assemblies 201 is pivotably coupled between the center support pole 101 and a corresponding set 150 of the edge scissor assemblies 201. In more detail, each center scissor assembly 201 is pivotably coupled between the upper and lower connecting brackets 104, 106 and upper and lower central hubs 108, 110 on the center support pole 101. Each center scissor assembly is formed by pivotably coupling a pair of ribs 203 about their respective centers. The center scissor assembly 201 has substantially the same structure as the edge scissor assembly 200.

Figure 2:
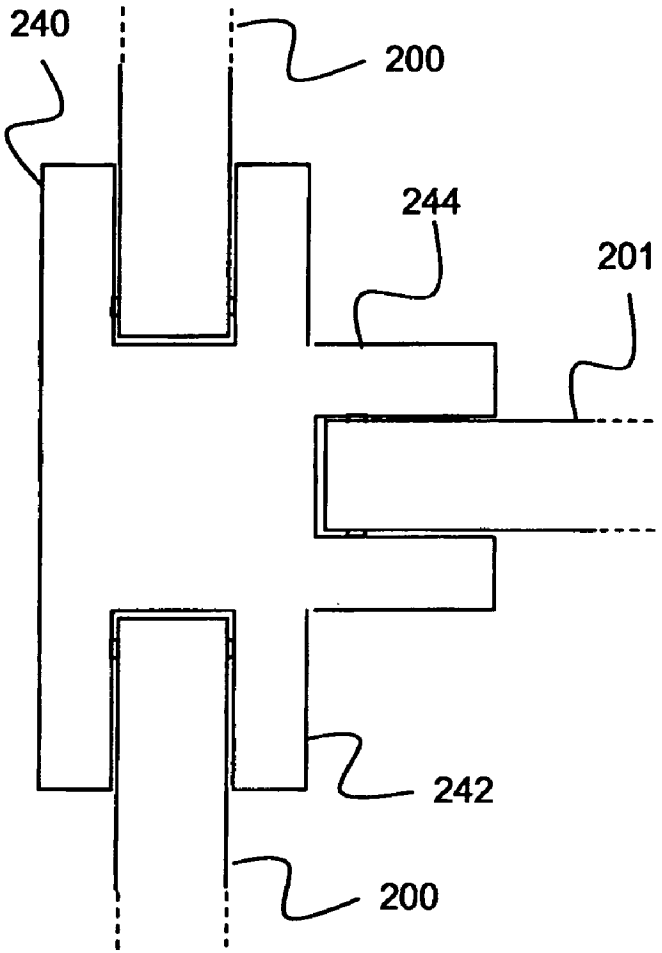
FIG. 2 is a cross-sectional view of a connecting bracket between adjacent edge scissor assemblies.

Referring now to FIGS. 1 and 2, each of the upper and lower connecting brackets 104 and 106 has three connecting members 240, 242 and 244. The connecting members 240 and 242 face at substantially 180 degrees of each other, and are used to pivotably couple the edge scissor assemblies 200 of the same set 150 to each other. The connecting member 244 faces at substantially a right angle with respect to each of the two 180-degree apart connecting members, and is used to pivotably couple the center scissor assembly 201 to the edge scissor assemblies 200.

Figure 3:
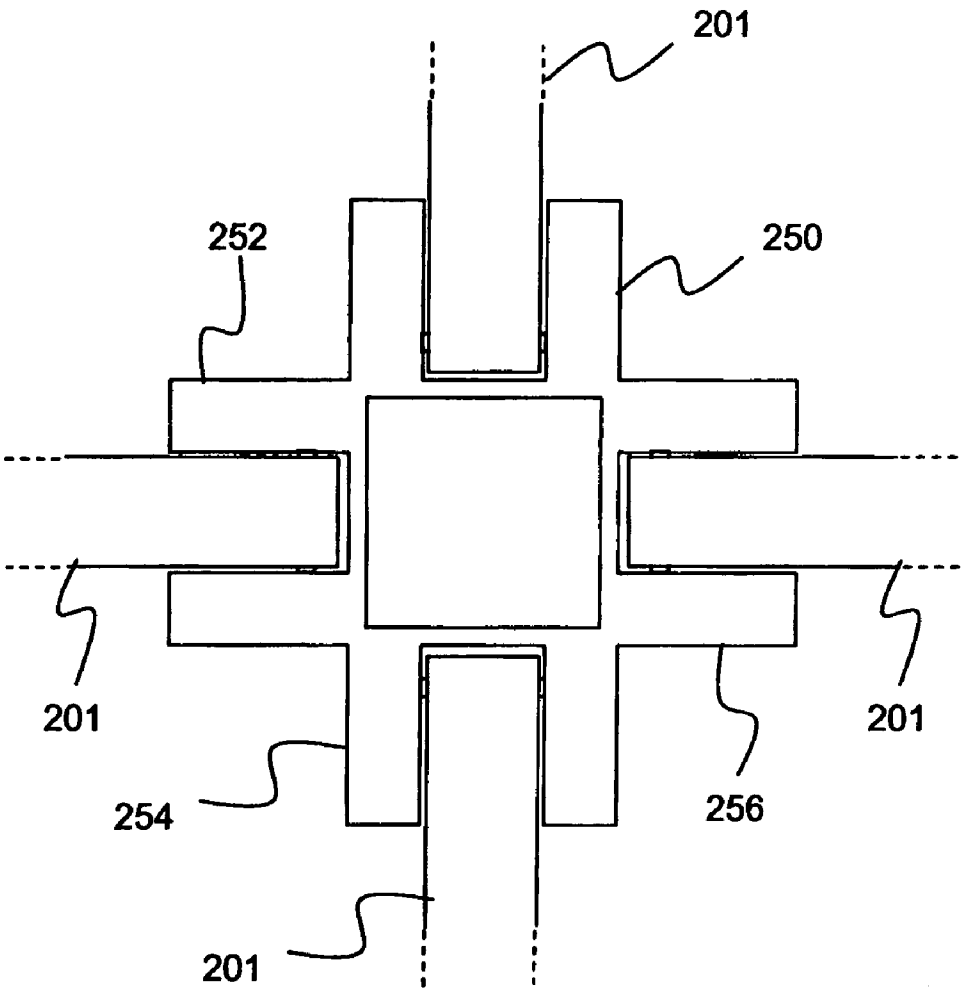
FIG. 3 is a cross-sectional view of a central hub mounted on a center support pole.

Referring now to FIGS. 1 and 3, each of the upper and lower central hubs 108 and 110 has four connecting members 250, 252, 254, 256, each facing one set of edge scissor assemblies. The upper and lower central hubs are pivotably connected to four different center scissor assemblies 201 that extend at approximately 90-degrees apart from one other. Hence, each center scissor assembly 201 is pivotably coupled between the center support pole 101 and the corresponding set 150 of the edge scissor assemblies 200.

Figure 4:
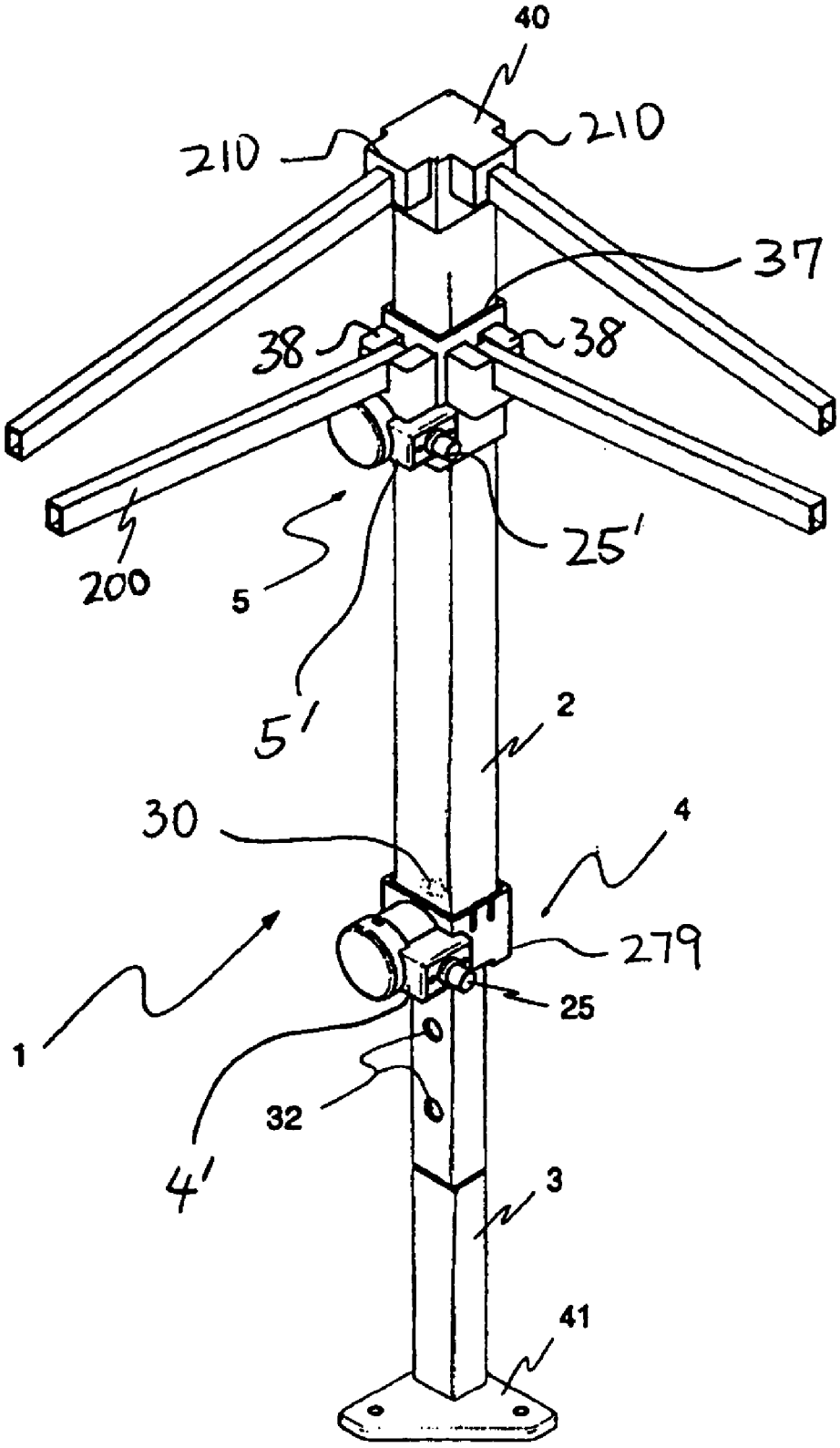
FIG. 4 is a view of a telescoping pole in the canopy frame of FIG. 1.
Figure 5:
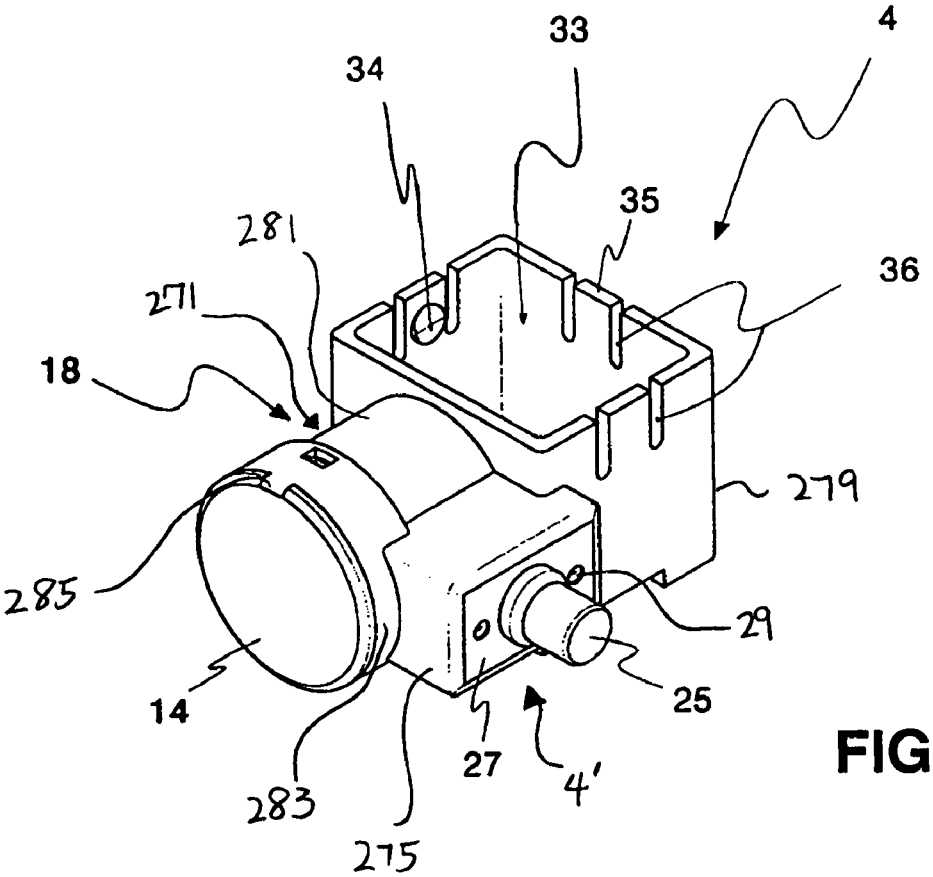
FIG. 5 is a perspective view of a height adjustment bracket in an exemplary embodiment according to the present invention.
Figure 6:
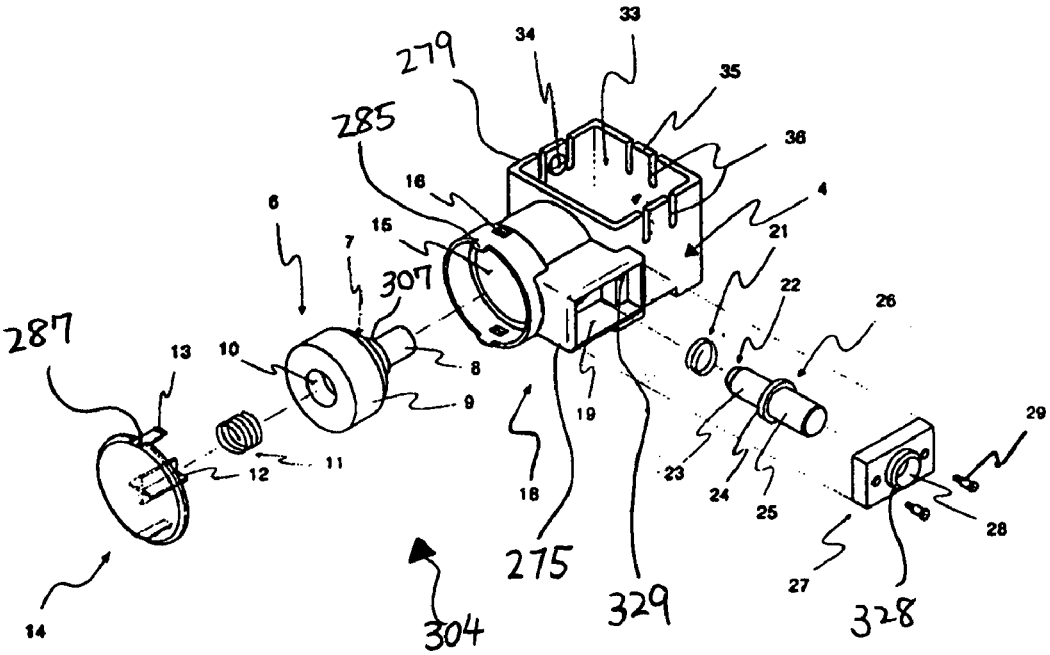
FIG. 6 is an exploded view of the height adjustment bracket of FIG. 5.

FIG. 4 is a detailed view of one of the side poles 1 of the collapsible canopy frame 100. The stationary mounting bracket 40 has two connecting members 210 that face at substantially a right angle to each other for pivotably coupling with the corresponding edge scissor assemblies 200. Similarly, the sliding mounting bracket 5 has two connecting members 38 facing at substantially a right angle to each other for pivotably coupling with the corresponding edge scissor assemblies 200. The sliding mounting bracket 5 has an opening 37 therethrough for slidably coupling with the upper section 2. The opening 37 has a substantially square cross sectional shape to receive in close but slidably fitting relation, the upper section 2, which has a substantially square cross sectional shape.

FIGS. 1 and 4 illustrate the collapsible canopy frame 100 and the side pole 1, respectively, in a fully opened state, in which the ribs 202 and 203 are in a generally horizontal orientation. As the canopy is being collapsed, the angle between the scissor assemblies and the connecting members 210 and 38 decreases, and the distance between the adjacent side poles 1 decreases. Meanwhile, the sliding mounting bracket 5 slides along the upper section 2 in a downward direction towards the fixing bracket 4 and away from the stationary mounting bracket 40.

Referring now to FIGS. 4-9, the height adjustment bracket 4 includes a fixing section 279 and a height adjustment locking pin assembly 4' used to fix the lower section 3 to the upper section 2. The height adjustment locking pin assembly 4' of the height adjustment bracket 4 can lock the sections 2 and 3 of the telescoping side pole in various different extended positions. The locking mechanism between the upper section 2 and the lower section 3 can be released by pressing a pressing member 25. The lower section 3 has formed thereon a number of holes 32 such that a locking pin of the locking pin assembly 4' can engage the holes to fix the upper section 2 with respect to the lower section 3 at various different heights. In other embodiments, the telescoping side poles may have three or more telescoping sections that are lockable to one another using same or similar locking mechanisms.

The fixing section 279 has a generally cubic shape with a central opening 33 having a substantially square opening therethrough for slidably engaging the upper section 2. The fixing section 279 has formed perpendicular to its upper periphery two elongated openings 36 that extend from the upper periphery to define a substantially rectangular resilient member 35 about the middle of each of the four sides surrounding the central opening 33. On one of the resilient members 35 is formed a cylindrical stub 34 for engaging a fixing hole 30 (shown in phantom line in FIG. 4) on the upper section 2 such that the fixing section 279 and therefore the height adjustment bracket 4 can be fixed on the upper section 2.

In other embodiments, any other suitable mechanism may be used to fix the height adjustment bracket on the upper section. In still other embodiments, the height adjustment bracket may be slidable on the upper section, and may be fixed to the upper section using only a locking pin assembly.

The height adjustment locking pin assembly 4' includes a housing 18. The housing 18 has a generally cylindrical chamber 271 and a generally box-shaped chamber 275. The generally cylindrical chamber 271 defines a cavity 15 within which a locking pin member 6 is installed. The generally cylindrical chamber 271 has a lower section 281 having a smaller radius and an upper section 283 having a larger radius.

On the peripheral edge of the upper section 283 away from the side abutting the lower section 281 are formed two protruding stubs 285 that are substantially 180 degrees apart from one another and are used to engage a cover 14 for the generally cylindrical section 271. On the peripheral surface of the upper section 283 are formed two openings 16 that are aligned with the respective protruding stubs 285 to engage the cover 14.

The cover 14 has a substantially circular shape for covering the cavity 15. The cover 14 has formed thereon a pair of notches 287 that are 180 degrees apart from one another. The notches 287 are formed such that they engage the respective protruding stubs 285 when the cover 14 is placed on the upper section 283. The cover 14 also has protrudingly formed thereon, aligned with the notches 287, a pair of 180 degree apart engaging members 13. The engaging members 13 each have a tip for engaging the openings 16, respectively, such that the cover 14 is held in place on the upper section 283.

The cover 14 has also formed thereon a center support 12 for holding a biasing member 11 such as a spring in place. The center support 12 provides a structural support to the biasing member 11 so that the axis of the biasing member can remain substantially stable without providing such support by a locking pin. This way, it is not necessary for the end of the locking pin that supports the biasing member to protrude out of the housing 18 (e.g., through the cover 14) when the locking pin has moved in a direction against the biasing.

In the exemplary embodiment, the center support 12 has two rectangular planar members that are perpendicular to and bisect each other. The center support 12 extends from the inner surface of the cover 14 in a direction of the axis of the generally cylindrical section 271, i.e., in a direction parallel to the engaging members 13. The center support 12 may have other suitable shapes in other embodiments.

The locking pin member 6 includes a locking pin 8, an inclined portion 7, a connecting portion 307 and a biasing engagement portion 9. The locking pin 8 is substantially cylindrical in shape, and is coupled to the inclined portion 7 at one of its ends via the connecting portion 307, which is substantially disk-shaped. The inclined portion 7 has a circular cross-section with the radius of the circle being smaller at the end near the locking pin 8 than at the other end, such that has an inclined (or sloped) appearance between the two ends.

The biasing engagement portion 9 is doughnut shaped where its radius of the outer surface is substantially the same as the radius of the larger end of the inclined portion 7. The radius of the outer surface of the biasing engagement portion 9 is also suited to slidably engage the inner surface of the lower section 281 such that the peripheral wall of the lower section 281 guides the movement path of the locking pin member 6. The inner surface of the biasing engagement portion 9 defines a cavity 10 that can be used to hold at least a portion of the biasing member 11, thereby engaging the biasing member, which is between the cover 14 and the locking pin member 6.

When the cover 14 is placed on the substantially cylindrical section 271, the center support 12 supports the biasing member 11 to be aligned with the center axis of the locking pin 8 and the locking pin body 9. The biasing member 11 tends to bias the locking pin 8 towards the fixing section 279.

The locking pin 8, the connecting portion 307, the inclined portion 7 and the biasing engagement portion 9 may, for example, be formed as a single integrated piece to form the locking pin member 6. In other embodiments, the locking pin may be directly attached to the inclined portion and not via a connecting portion.

Figure 7:
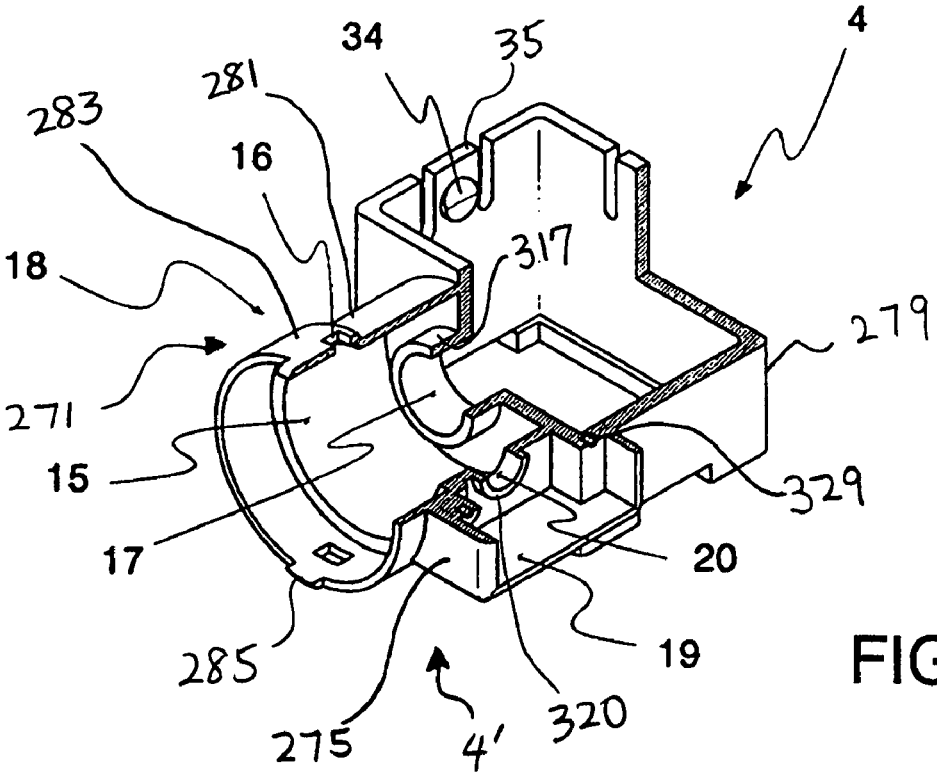
FIG. 7 is a partial view of the height adjustment bracket of FIG. 5.
Figure 8:
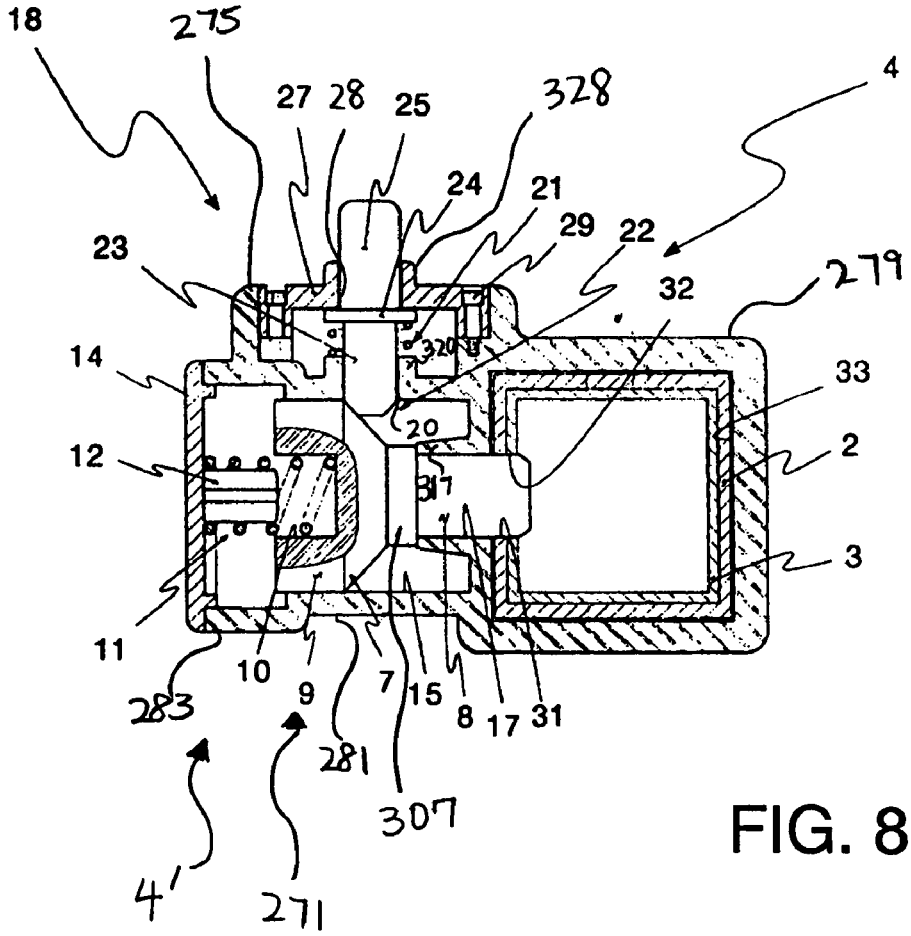
FIG. 8 is a cross-sectional view of the height adjust bracket of FIG. 5, in which the locking pin is in a normally biased position.
Figure 9:
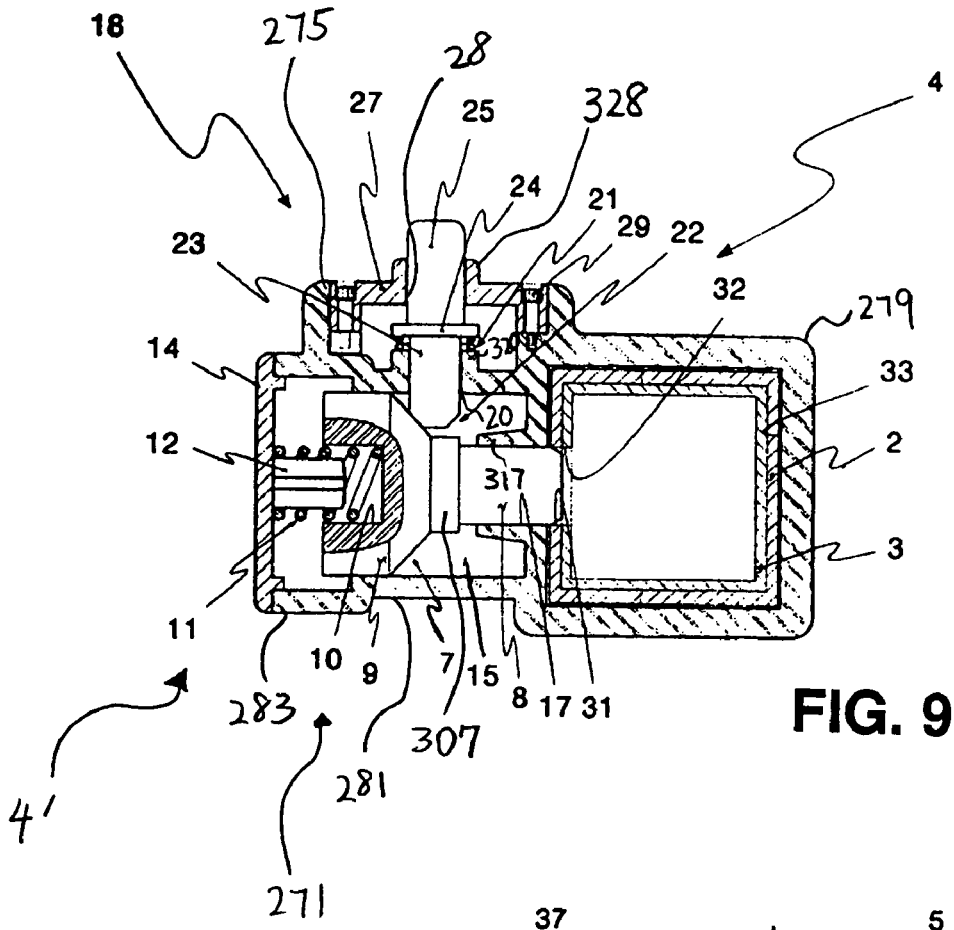
FIG. 9 is a cross-sectional view of the height adjust bracket of FIG. 5, in which the locking pin has been moved away from the normally biased position.
Figure 10:
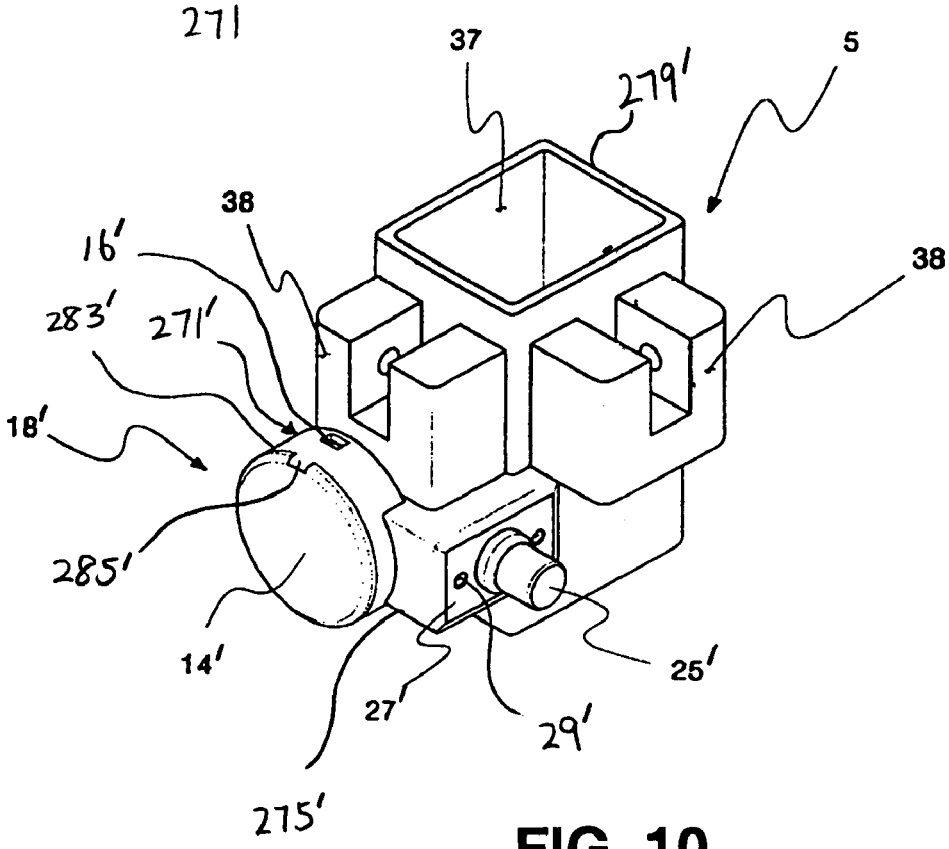
FIG. 10 is a perspective view of a sliding mounting bracket in an exemplary embodiment of the present invention.
Figure 11:
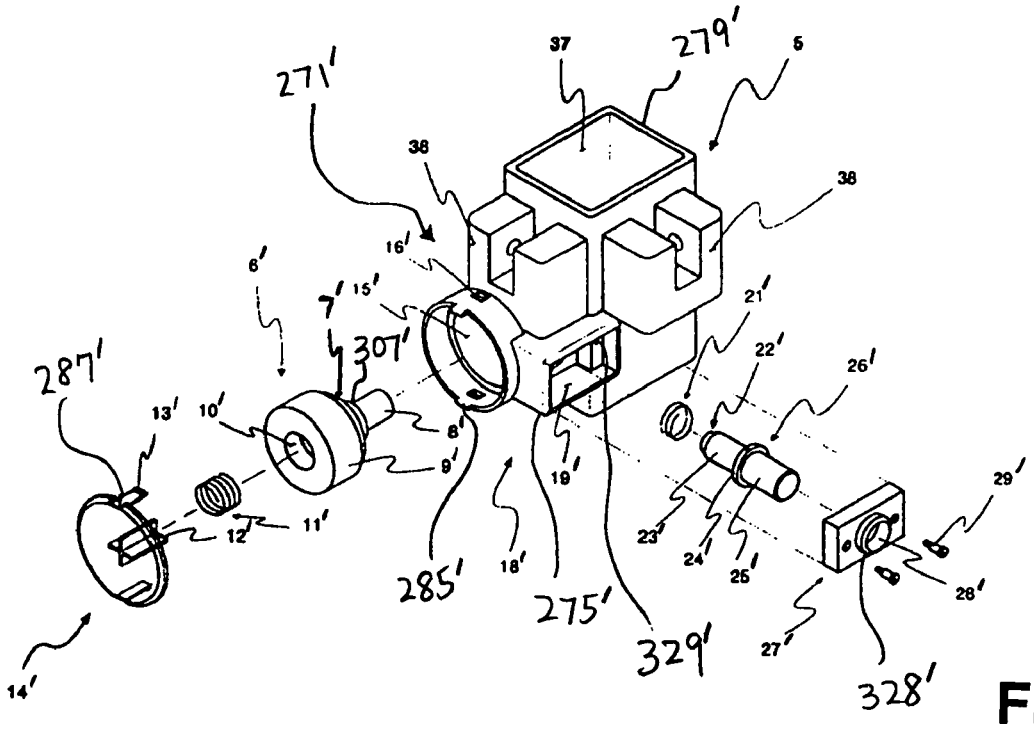
FIG. 11 is an exploded view of the sliding mounting bracket of FIG. 10.
Figure 12:
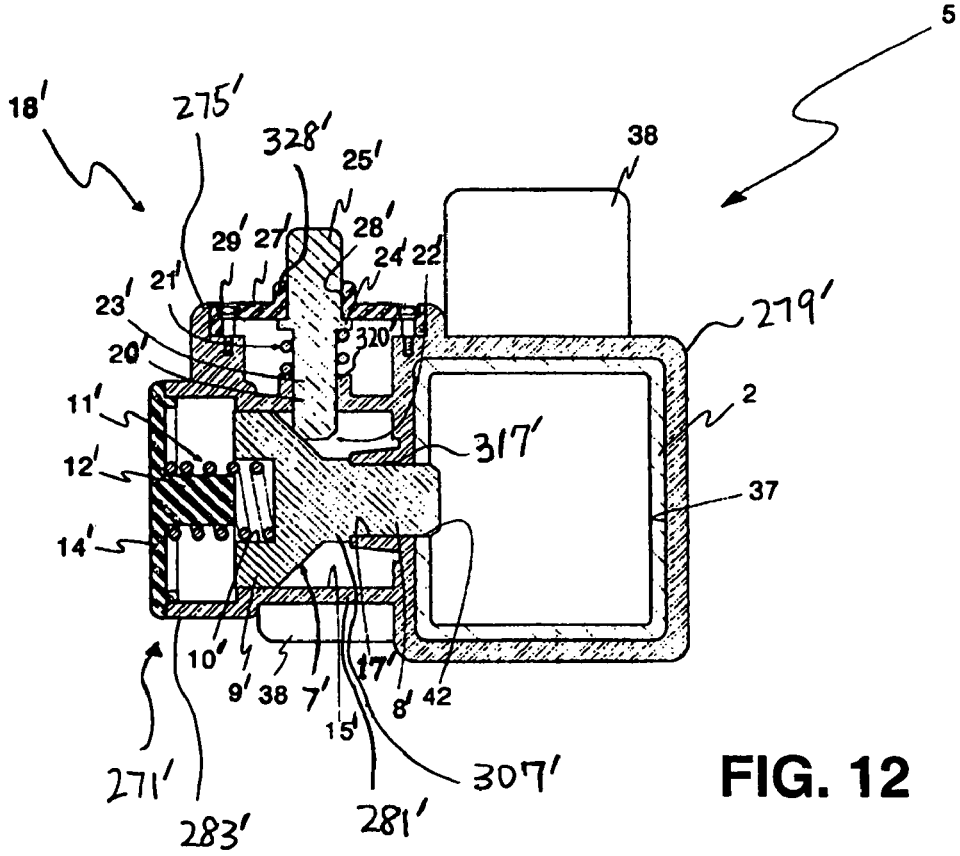
FIG. 12 is a cross-sectional view of the sliding mounting bracket of FIG. 10.

As can be seen in FIGS. 7-9, the generally cylindrical section 271 has formed therein an opening 17, which has a cylindrical wall 317 surrounding the opening. The opening 17 leads to a side of the central opening 33, so that at least a portion (e.g., a tip) of the locking pin 8 can enter the central opening 33 through the opening 17. The cylindrical wall 317 slidably couples with the locking pin 8 so as to guide its movement path. Further, the peripheral edge of the cylindrical wall 317 engages the connecting portion 307 such that the locking pin member 6 is stopped from further penetrating into the central opening 33.

The locking pin assembly 4' also includes a button 26 having a pressing member 25, a connecting portion 24 and an engagement member 23, all of which may be formed as a single integrated piece. The pressing member 25 and the engagement member 23 have a substantially cylindrical shape. The pressing member 25 and the engagement member 23 are co-axial with the pressing member 25 on one side of the connecting portion 24 and the engagement member 23 on the other side. The connecting portion 24 is substantially disk-shaped, and forms a flange between the pressing member 25 and the engagement member 23.

The engagement member 23 has formed at the end opposite the end attached to the connecting portion 24 a tapered tip 22. The locking pin assembly 4' also includes a biasing member 21 such as a spring that is placed around the engagement member 23. In the exemplary embodiment, the pressing member 25 has a cross-sectional radius that is larger than the cross-sectional radius of the engagement member 23. In other embodiments, the cross-sectional radii of the pressing member and the engaging member may be different.

The button 26 is installed in a cavity 19 of the generally box-like chamber 275 using a button cover 27. The biasing member 21, the engagement member 23 and the connecting portion 24 are placed in the cavity 19 and covered by the button cover 27, which is placed so as to close the cavity 19. The button cover 27 has formed thereon a circular opening 28 for engaging the flange formed by the connecting portion 24, such that the button 26 is biased towards the button cover 27, but held in place by the button cover. The pressing member 25 protrudes externally from the circular opening 28, so that it can be accessed (e.g., pressed) from outside of the cavity 19. The button cover 27 has formed on its external surface a cylindrical wall 328 around the circular opening 28.

The generally box-like chamber 275 has formed therein a pair of holes 329 each for receiving a screw. Using the holes 329, the button cover 27 is fixed in a position to cover the cavity 19 of the generally box-like chamber 275, in which screws 29 are used to fasten the button cover 27 to the generally box-like chamber 275.

The generally box-like chamber 275 has formed therein a circular opening 20 for slidably engaging the engagement member 23. The circular opening 20 provides an access of the engagement member 23 through the cylindrical side wall into the cavity 15 in the lower section 281 of the generally cylindrical section 271. The circular opening 20 has a cylindrical wall 320 about the periphery of the opening. The cylindrical wall 320 guides the movement path of the engagement member 23. The biasing member 21 is placed between the cylindrical wall 320 and the flange formed by the connecting portion 24 such that the button 26 is biased towards the button cover 27. At the same time, the periphery of the opening 28 on the internal surface of the button cover 27 engages the flange so as to stop the engagement member 23 from exiting the cavity 19 of the generally rectangular section 275.

The operation of the locking pin assembly 4' may best be described in reference to FIG. 8, which shows a normally biased position of the locking pin 8, and FIG. 9, which shows the position of the locking pin 8 when the pressing member 25 has been pressed.

In FIG. 8, the biasing member 11 is in a relatively extended (i.e., uncompressed) state between the cover 14 and the biasing engagement portion 9. The biasing member 11 is supported by the center support 12 such that its axis is not moved with respect to the cover 14 or the locking pin member 6. In this position, the biasing member biases the locking pin member 6 toward the central opening 33 of the fixing section 279, such that the tip of the locking pin 8 is within the central opening 33.

Therefore, the locking pin 8 fixes the upper section 2 and the lower section 3 with respect to each other by engaging the holes 31 and 32 of the upper and lower sections, respectively. The cylindrical stub 34 on the resilient member 35 fixes the height adjustment bracket 4 to the upper section 2 by engaging the hole 30 (illustrated in phantom line in FIG. 4). Also, the height adjustment bracket 4 is fixed to the upper section 2 via the portion of the locking pin 8 that has entered the hole 31 of the upper section 2.

The tapered tip 22 of the engagement member 23 engages the inclined portion 7. Since the biasing member 21 is placed between the flange formed by the connecting portion 24 and the cylindrical wall 320, the flange formed by the connecting portion 24 is biased towards the opening 28 of the button cover 27 away from the inclined portion 7 of the locking pin member 6. However, since the flange is larger than the opening 28, a portion of the button 26 on one side of the connecting portion 24 remains within the cavity 19 of the generally box-like chamber 275.

When the pressing member 25 is pressed in a first direction towards the locking pin member 6 as seen in FIG. 9, the tapered end 22 of the engagement member 23 slides with respect to the inclined portion 7, such that the locking pin member 6 is moved towards the cover 14 and away from the central opening 33. In other words, the cylindrical member 23 pushes the inclined portion 7 in a second direction, which is substantially 90 degrees with respect to the first direction. Therefore, when the pressing member 25 of the button 26 is pressed, the inclined portion 7, and hence, the locking pin 8 is moved in a direction against the biasing of the spring 11. Therefore, the tip of the locking pin 8 is disengaged from the hole 32, such that the upper and lower sections 2 and 3 can slide with respect to each other, thereby enabling height adjustment of the side pole 1.

Such pressing of the pressing member 25 may be accomplished using one hand, while the other hand is used to adjust the relative positions between the upper and lower sections 2 and 3. After disengaging the locking pin 8 by pressing the pressing member 25 and moving the upper section 2 with respect to the lower section 3, the upper and lower sections can be fixed to each other again by releasing the button when the hole 31 is aligned with one of the holes 32 of the lower section 3.

Referring back to FIG. 4, the sliding bracket 5 includes the sliding locking pin assembly 5' and a sliding section 279'. The sliding section 279' has a general shape of an elongated cube and has a central opening 37 having a substantially square opening therethrough for slidably engaging the upper section 2. The sliding section 279' has respectively formed at two 90 degree apart sides two connecting members 38 for pivotably coupling with ribs 200 of the edge scissor assemblies as discussed above.

It can be seen in FIGS. 4 and 10-12 that the sliding locking pin assembly 5' has a structure and operation that are substantially the same as the structure and operation of the height adjustment locking pin assembly 4'. Only notable difference may be that, unlike the height adjustment locking pin assembly 4', the sliding locking pin assembly 5' engages a hole 42 on the upper section 2 of the side pole 1, but not the lower section 3.

For example, each component of the sliding locking pin assembly corresponds with a component of the height adjustment locking pin assembly 4'. A prime (') symbol has been added to the reference numerals for the components to distinguish them from the components for the height adjustment locking pin assembly 4'. Therefore, the operation of the sliding locking pin assembly 5' will not be discussed herein. Instead, only its structure will be described briefly.

The height adjustment locking pin assembly 5' includes a housing 18', which includes a generally cylindrical chamber 271' which defines a cavity 15', and a generally box-like chamber 275'. The generally cylindrical chamber 271' includes an upper section 283' and a lower section 281'. The upper section 283' has formed at its peripheral edge a pair of protruding stubs 285'. The upper section 283' also has formed on its peripheral cylindrical surface a pair of openings 16'.

The cavity 15' is covered by a cover 14' which has formed thereon a pair of notches 287' for engaging the protruding stubs 285', a pair of engagement members 13' for engaging the openings 16', and a center support 12'. A cavity 19' of the generally box-like chamber 275' is covered by a button cover 27' having a circular opening 28' and a cylindrical wall 328' along the periphery of the circular opening 28'. Screws 29' are used to attach the cover 27' to the box-like chamber 275' using holes 329' inside the cavity 19'.

A biasing member 11' is held in place by the center support 12', and engages a locking pin member 6'. The locking pin member 6' includes a biasing engagement portion 9' (which defines a cavity 10 for engaging the biasing member 11'), an inclined portion 7', a connecting portion 307' and a locking pin 8'. The tip of the locking pin 8' exits the generally cylindrical chamber 271' through an opening 17' to engage the hole 42 on the upper section 2. A cylindrical wall 317' is formed around the periphery of the opening 17'

A button 26' includes a pressing member 25', a connecting portion 24' and an engagement member 23'. The engagement member 23' has a tapered tip 22' for engaging the inclined portion 7' of the locking pin member 6'. A biasing member 21' engages the button 26', and is disposed between the cover 27' and a cylindrical wall 320' formed around the periphery of an opening 20' between the box-like chamber 275' and the cylindrical chamber 271'.

It will be appreciated by those of ordinary skill in the art that the invention can be embodied in other specific forms without departing from the spirit or essential character thereof. The present invention is therefore considered in all respects to be illustrative and not restrictive. The scope of the invention is indicated by the appended claims, and all changes that come within the meaning and range of equivalents thereof are intended to be embraced therein.

For example, while the locking pin assemblies are described herein for applications in a collapsible canopy frame, they can be applied to any telescoping poles or other structures that require such locking pin assemblies.

I claim:

1. A locking pin assembly comprising:

a button movable in a first direction from a first position to a second position;

a first biasing member for biasing the button to be normally in the first position;

a locking pin member engaging the button and movable in a second direction, which is substantially perpendicular to the first direction, from a third position to a fourth position when the button is moved from the first position to the second position;

a second biasing member for biasing the locking pin member to be normally in the third position;

a housing for holding the first biasing member, the second biasing member, at least a portion of the button, and at least a portion of the locking pin member; and a cover for the housing, said cover comprising a support member for providing a structural support to the second biasing member.

2. A locking pin assembly comprising:

a button movable in a first direction from a first position to a second position;

a first biasing member for biasing the button to be normally in the first position;

a locking pin member engaging the button and movable in a second direction, which is substantially perpendicular to the first direction, from a third position to a fourth position when the button is moved from the first position to the second position;

a second biasing member for biasing the locking pin member to be normally in the third position, and a housing for holding the first biasing member, the second biasing member, at least a portion of the button, and at least a portion of the locking pin member, wherein the button comprises:

a pressing member having a first end and a second end, the first end protruding out of the housing through a first opening on the housing when the button is in the first position;

an engagement member having a first end and a second end, said first end having a tapered tip for engaging the locking pin member; and a connecting portion disposed between the pressing member and the engagement member, said connecting portion forming a flange between the pressing member and the engagement member, wherein a radius of the flange is larger than that of the first opening such that the flange prevents the engagement member from exiting the housing when the first biasing member biases the button towards the first position.

3. The locking pin assembly of claim 2, wherein the locking pin member comprises:

a locking pin having a first end and a second end, the first end protruding out of the housing through a second opening on the housing when the locking pin member is in the third position;

an inclined portion that engages the tapered tip of the engagement member; and a disk shaped connecting portion disposed between the locking pin and the inclined portion, wherein a radius of the disk shaped connecting portion is larger than that of the second opening such that the disk shaped connecting portion prevents the inclined portion from exiting the housing when the second biasing member biases the locking pin member towards the third position.

4. The locking pin assembly of claim 3, wherein as the pressing member of the button is pressed, the button moves in the first direction towards the second position, and the tapered tip of the engagement member slides with respect to the inclined portion of the locking pin member such that the locking pin member is moved in the second direction towards the fourth position.

5. A height adjustment bracket for a collapsible canopy comprising a plurality of telescoping side poles, each having upper and lower telescoping sections, and a plurality of edge scissor assemblies that interconnect the side poles, the height adjustment bracket being for fixing the upper and lower telescoping sections together and comprising:

a fixing section for engaging a corresponding said upper telescoping section; and a locking pin assembly attached to the fixing section, comprising:

a button movable in a first direction from a first position to a second position;

a first biasing member for biasing the button to be normally in the first position;

a locking pin member engaging the button and movable in a second direction, which is substantially perpendicular to the first direction, from a third position for fixing corresponding said upper and lower telescoping sections together to a fourth position for disengaging the lower telescoping section from the upper telescoping section when the button is moved from the first position to the second position; and a second biasing member for biasing the locking pin member to be normally in the third position.

6. The height adjustment bracket of claim 5, wherein the locking pin assembly further comprises a housing for holding the first biasing member, the second biasing member, at least a portion of the button, and at least a portion of the locking pin member.

7. The height adjustment bracket of claim 6, further comprising a cover for the housing, said cover comprising a support member for providing a structural support to the second biasing member.

8. The height adjustment bracket of claim 6, wherein the button comprises:

a pressing member having a first end and a second end, the first end protruding out of the housing through a first opening on the housing when the button is in the first position;

an engagement member having a first end and a second end, said first end having a tapered tip for engaging the locking pin member; and a connecting portion disposed between the pressing member and the engagement member, said connecting portion forming a flange between the pressing member and the engagement member, wherein a radius of the flange is larger than that of the first opening such that the flange prevents the engagement member from exiting the housing when the first biasing member biases the button towards the first position.

9. The height adjustment bracket of claim 8, wherein the locking pin member comprises:

a locking pin having a first end and a second end, the first end protruding out of the housing through a second opening on the housing when the locking pin member is in the third position;

an inclined portion that engages the tapered tip of the engagement member; and a disk shaped connecting portion disposed between the locking pin and the inclined portion, wherein a radius of the disk shaped connecting portion is larger than that of the second opening such that the disk shaped connecting portion prevents the inclined portion from exiting the housing when the second biasing member biases the locking pin member towards the third position.

10. The height adjustment bracket of claim 9, wherein as the pressing member of the button is pressed, the button moves in the first direction towards the second position, and the tapered tip of the engagement member slides with respect to the inclined portion of the locking pin member such that the locking pin member is moved in the second direction towards the fourth position.

11. The height adjustment bracket of claim 5, wherein the fixing section includes at least one resilient member and a stub formed thereon, wherein the stub is used to engage a hole on the upper telescoping section so as to fix the height adjustment bracket to the upper telescoping section.

12. A sliding mounting bracket for a collapsible canopy comprising a plurality of side poles, and a plurality of edge scissor assemblies that interconnect the side poles, the sliding mounting bracket being for coupling the edge scissor assemblies to the side poles and comprising:

a sliding section for slidably engaging a corresponding said side pole; and a locking pin assembly attached to the sliding section, comprising:

a button movable in a first direction from a first position to a second position;

a first biasing member for biasing the button to be normally in the first position;

a locking pin member engaging the button and movable in a second direction, which is substantially perpendicular to the first direction, from a third position for fixing the sliding mounting bracket to the side pole to a fourth position for disengaging the sliding mounting bracket from the side pole when the button is moved from the first position to the second position; and a second biasing member for biasing the locking pin member to be normally in the third position.

13. The sliding mounting bracket of claim 12, wherein the locking pin assembly further comprises a housing for holding the first biasing member, the second biasing member, at least a portion of the button, and at least a portion of the locking pin member.

14. The sliding mounting bracket of claim 13, wherein the locking pin assembly further comprises a cover for the housing, said cover comprising a support member for providing a structural support to the second biasing member.

15. The sliding mounting bracket of claim 13, wherein the button comprises:

a pressing member having a first end and a second end, the first end protruding out of the housing through a first opening on the housing when the button is in the first position;

an engagement member having a first end and a second end, said first end having a tapered tip for engaging the locking pin member; and a connecting portion disposed between the pressing member and the engagement member, said connecting portion forming a flange between the pressing member and the engagement member, wherein a radius of the flange is larger than that of the first opening such that the flange prevents the engagement member from exiting the housing when the first biasing member biases the button towards the first position.

16. The sliding mounting bracket of claim 15, wherein the locking pin member comprises:

a locking pin having a first end and a second end, the first end protruding out of the housing through a second opening on the housing when the locking pin member is in the third position;

an inclined portion that engages the tapered tip of the engagement member; and a disk shaped connecting portion disposed between the locking pin and the inclined portion, wherein a radius of the disk-shaped connecting portion is larger than that of the second opening such that the disk shaped connecting portion prevents the inclined portion from exiting the housing when the second biasing member biases the locking pin member towards the third position.

17. The sliding mounting bracket of claim 16, wherein as the pressing member of the button is pressed, the button moves in the first direction towards the second position, and the tapered tip of the engagement member slides with respect to the inclined portion of the locking pin member such that the locking pin member is moved in the second direction towards the fourth position.

18. A collapsible canopy frame comprising:

a plurality of telescoping side poles, each telescoping side pole having an upper section and a lower section;

a height adjustment bracket mounted on each telescoping side pole, comprising:

a fixing section for engaging the upper section; and a first locking pin assembly connected to the fixing section, comprising:

a first button movable in a first direction from a first position to a second position;

a first biasing member for biasing the button to be normally in the first position;

a first locking pin member engaging the first button and movable in a second direction, which is substantially perpendicular to the first direction, from a third position for fixing the upper and lower sections together to a fourth position for disengaging the lower section from the upper section when the first button is moved from the first position to the second position; and a second biasing member for biasing the first locking pin member to be normally in the third position;

a set of edge scissor assemblies that are pivotably coupled between each of pairs of the side poles, each of said edge scissor assemblies having relatively rotatable ribs;

a stationary mounting bracket fixedly mounted at top of each telescoping side pole, said stationary mounting bracket being pivotably coupled with upper outer ends of two respective edge scissor assemblies; and a sliding mounting bracket slidably mounted between the stationary mounting bracket and the height adjustment bracket on each of the telescoping side poles, said sliding mounting bracket being pivotably coupled with lower outer ends of two respective edge scissor assemblies.

19. The collapsible canopy frame of claim 18, wherein the sliding mounting bracket comprises:

a sliding section for slidably engaging the upper section of the telescoping side pole; and a second locking pin assembly connected to the sliding section, comprising:

a second button movable in a third direction from a fifth position to a sixth position;

a third biasing member for biasing the second button to be normally in the fifth position;

a second locking pin member engaging the second button and movable in a fourth direction, which is substantially perpendicular to the third direction, from a seventh position for fixing the sliding mounting bracket to the upper section of the side pole to an eighth position for disengaging the sliding mounting bracket from the upper section of the side pole when the second button is moved from the fifth position to the sixth position; and a fourth biasing member for biasing the second locking pin member to be normally in the seventh position.

20. The collapsible canopy frame of claim 18, wherein each lower section has a plurality of vertically apart holes formed thereon, such that the height of each side pole can be adjusted by engaging different ones of the holes with the first locking pin member.

21. The collapsible canopy frame of claim 18, further comprising:

a center support pole; and a plurality of center scissor assemblies, each center scissor assembly being pivotably coupled between the center support pole and a corresponding said set of the edge scissor assemblies.

22. A collapsible canopy frame comprising:

a plurality of side poles;

a set of edge scissor assemblies that are pivotably coupled between each of pairs of the side poles, each of said edge scissor assemblies having relatively rotatable ribs;

a stationary mounting bracket fixedly mounted at top of each side pole, said stationary mounting bracket being pivotably coupled with upper outer ends of two respective edge scissor assemblies; and a sliding mounting bracket slidably mounted below the stationary mounting bracket on each of the side poles, said sliding mounting bracket being pivotably coupled with lower outer ends of two respective edge scissor assemblies, the sliding mounting bracket comprising:

means for slidably engaging the side pole; and a locking pin assembly connected to the slidably engaging means, comprising:

a first button movable in a first direction from a first position to a second position;

first biasing means for biasing the first button to be normally in the first position;

a first locking pin member engaging the first button and movable in a second direction, which is substantially perpendicular to the first direction, from a third position for fixing the sliding mounting bracket to the side pole to a fourth position for disengaging the sliding mounting bracket from the side pole when the first button is moved from the first position to the second position; and second biasing means for biasing the first locking pin member to be normally in the third position.

23. The collapsible canopy frame of claim 22, wherein each of the side poles is a telescoping side pole having an upper section and a lower section, further comprising:

a height adjustment bracket mounted on each telescoping side pole, comprising:

a fixing section for engaging the upper section; and a second locking pin assembly connected to the fixing section, comprising:

a second button movable in a third direction from a fifth position to a sixth position;

third biasing means for biasing the second button to be normally in the fifth position;

a second locking pin member engaging the second button and movable in a fourth direction, which is substantially perpendicular to the third direction, from a seventh position for fixing the upper and lower sections together to an eighth position for disengaging the lower section from the upper section when the second button is moved from the fifth position to the sixth position; and fourth biasing means for biasing the second locking pin member to be normally in the seventh position.

* * * * *